US008307611B2

(12) United States Patent
Iwasaki et al.

(10) Patent No.: US 8,307,611 B2
(45) Date of Patent: Nov. 13, 2012

(54) STRIP-PACK MANUFACTURING APPARATUS

(75) Inventors: Yoshio Iwasaki, Shiga (JP); Akira Yamamoto, Shiga (JP); Michio Nishi, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 89 days.

(21) Appl. No.: 12/682,237

(22) PCT Filed: Oct. 2, 2008

(86) PCT No.: PCT/JP2008/067927

§ 371 (c)(1),
(2), (4) Date: Apr. 8, 2010

(87) PCT Pub. No.: WO2009/054245

PCT Pub. Date: Apr. 30, 2009

(65) Prior Publication Data

US 2010/0236189 A1 Sep. 23, 2010

(30) Foreign Application Priority Data

Oct. 23, 2007 (JP) ..... 2007-274638

(51) Int. Cl.
*B65B 61/00* (2006.01)
*B65B 15/00* (2006.01)
*B65B 15/04* (2006.01)

(52) U.S. Cl. ..... 53/135.1; 53/136.1

(58) Field of Classification Search ..... 53/135.1, 53/136.1; 198/629, 782; 100/168; *B65B 15/00, B65B 15/04*
See application file for complete search history.

(56) References Cited

U.S. PATENT DOCUMENTS

| | | | | |
|---|---|---|---|---|
| 3,864,895 | A | 2/1975 | Petrea | |
| 5,433,060 | A * | 7/1995 | Gur et al. | 53/413 |
| 6,726,794 | B2 * | 4/2004 | Belt | 156/265 |
| 7,003,926 | B2 * | 2/2006 | Yamamoto et al. | 53/136.1 |
| 7,093,404 | B2 * | 8/2006 | Kubo et al. | 53/136.1 |
| 7,293,591 | B2 * | 11/2007 | Nakagawa et al. | 156/362 |
| 7,383,672 | B2 * | 6/2008 | Taylor et al. | 53/134.1 |
| 2004/0043882 | A1 | 3/2004 | Kubo et al. | |
| 2004/0168774 | A1 | 9/2004 | Nakagawa et al. | |
| 2004/0255554 | A1 * | 12/2004 | Yamamoto et al. | 53/136.1 |
| 2006/0086682 | A1 * | 4/2006 | Iwasaki et al. | 211/113 |
| 2007/0261366 | A1 * | 11/2007 | Iwamoto et al. | 53/136.1 |

FOREIGN PATENT DOCUMENTS

| | | | |
|---|---|---|---|
| EP | 2088082 | A1 | 8/2009 |
| JP | 2004-090948 | A | 3/2004 |
| JP | 2004-182302 | A | 7/2004 |
| JP | 2004-262482 | A | 9/2004 |
| JP | 2007-112502 | A | 5/2007 |
| WO | WO-2008/050592 | A1 | 5/2008 |

* cited by examiner

*Primary Examiner* — Lindsay Low
*Assistant Examiner* — Eyamindae Jallow
(74) *Attorney, Agent, or Firm* — Global IP Counselors, LLP

(57) ABSTRACT

A strip-pack manufacturing apparatus is adapted to attach an end part of an article to a strip. The strip-pack manufacturing apparatus includes a holding part, first and second rollers, a stopper member and an adjusting part. The holding part is configured and arranged to hold and transport the article to a predetermined attaching position. The first and second rollers are arranged in a receiving position at which the holding part receives the article. The first and second rollers are configured and arranged to rotate while sandwiching the end part of the article therebetween. The stopper member is configured and arranged to control the position of the end part of the article that has been drawn by rotation of the first and second rollers to stop at a predetermined position. The adjusting part is configured and arranged to adjust a distance between rotation axes of the first and second rollers.

7 Claims, 9 Drawing Sheets

STRIP-PACK MANUFACTURING APPARATUS

CROSS-REFERENCE TO RELATED APPLICATIONS

This national phase application claims priority to Japanese Patent Application No. 2007-274638 filed on Oct. 23, 2007. The entire disclosure of Japanese Patent Application No. 2007-274638 is hereby incorporated herein by reference.

TECHNICAL FIELD

The present invention belongs to the technical field of manufacturing products called strip packs, which comprise a plurality of articles attached to a strip and is displayed in a suspended state.

BACKGROUND ART

Conventionally, there is known a product obtained by attaching a plurality of articles filled with snack foods or the like to a strip such as strip-like film, tape, or the like. The product is referred to as a "strip pack" because the product is displayed, in a retail store or the like, in a suspended state with a portion of a strip secured in place and customers pull individual articles off the strip. The strip packs allows a reduction in the display space while providing for a diverse range of designs, thus offering an advantage in terms of increasing customers' willingness to buy.

The device recited in Japanese Laid-Open Patent Application. No. 2004-182302 is an example of a strip-pack manufacturing apparatus for manufacturing strip packs of the above description. In the device, which is disposed directly beneath a vertical bag packaging machine, one end of an article manufactured by the bag packaging machine is clamped from both sides by a pair of gripping arms disposed to the left and right, and the article is moved to an attaching position located in a lower region, whereupon the end of the article is attached to a strip. In the device recited in U.S. Pat. No. 3,864,895, which is also disposed directly beneath a vertical bag packaging machine, an upper surface of an article manufactured by the machine is held by suction cups, and moved to an attaching position located to the front, whereupon one end of the article is attached to the strip.

SUMMARY

The strip-pack manufacturing apparatuses cited above as mentioned in the references are disposed directly beneath the bag packaging machine as a unit integrated therewith, and attach the packaged article directly to the strip. However, if, for example, the packaged article is to be attached to the strip after being examined, then the bag packaging machine and the strip-pack manufacturing apparatus are moved apart, and the article is attached to the strip after being conveyed from the packaging machine to a predetermined position.

In such instances, the article conveyed by a conveying part from the packaging part is held by a chuck or other holding part, and moved to the attaching position of the strip pack machine; however, if the article is not properly held by the holding part, an end of the article will not be securely attached to the strip by an attaching part. This may lead to the article falling off once it has been arranged on the strip.

To address this problem, a pair of brush rollers or other types of rollers and a stopper are arranged at a position where the holding part receives the article from the conveying part, the rollers rotating while sandwiching an end of the article, and the stopper controlling the position of the end of the article drawn between the rollers to stop at a predetermined position. As a result, the end of the article is meant to be securely held by the holding part while always being positioned at a predetermined position.

Nevertheless, if the thickness of the end of the article held between the rollers varies due to the thickness of the material used to package the article or another factor, then the end will not pass between the rollers if it is too thick, or will be insufficiently pulled between the rollers if it is too thin. In either case, it will be impossible to position the end of the article in the predetermined position, presenting a risk that the holding part will be incapable of securely holding the end.

It is accordingly an object of the present invention to ensure that in cases where an article is held by a chuck or other holding part and moved to an attaching position in a strip-pack manufacturing apparatus, the article will be always held in the correct orientation, regardless of thickness of the end of the bag, when the end of the article is held by the holding part while being sandwiched between the pair of rollers.

The strip-pack manufacturing apparatus according to a first aspect is adapted to attach an end part of an article on a strip. The strip-pack manufacturing apparatus includes a holding part, a pair of first and second rollers, a stopper member, and an adjusting part. The holding part is configured and arranged to hold and transport the article to a predetermined attaching position. The first and second rollers are arranged at a receiving position where the holding part receives the article. The first and second rollers are configured and arranged to rotate while sandwiching the end of the article therebetween. The stopper member is configured and arranged to control the position of the end of the article drawn by rotation of the first and second rollers to stop at a predetermined position. The adjusting part is configured and arranged to adjust a distance between rotation axes of the first and second rollers.

In a case where each of the pair of rollers is individually supported by a supporting member, the adjusting part is configured and arranged to move at least one of the supporting members to pivot around a pivot axis that is parallel to the rotation axes of the first and second rollers, thereby enabling the distance between the rotation axes of the first and second rollers to be adjusted.

In such cases, preferably, the strip-pack manufacturing apparatus further includes a drive roller driven by a motor and a driven roller that is in contact with the drive roller while being caused to rotate thereby. It is also preferable for the first and second rollers to be configured so as to rotate via winding transmission members in association with the drive roller and the driven roller, respectively. The pivot axis of the supporting member is preferably the rotation axis of one of the drive roller and the driven roller.

According to the present invention, the gap between the rollers can be adjusted by the adjusting part; therefore, adjusting the gap according to the thickness of the end of the article makes it possible to handle a variety of articles having different end thicknesses. As a result, the holding part is capable of securely holding the ends of the articles regardless of the end thickness.

In a case where the adjusting part causes at least one of the supporting members to pivot around the axis that is parallel to the rotation axis of the roller, the distance between the axes of the rollers can be readily adjusted merely by adjusting the pivot angle of the supporting member.

In a case where the drive roller causes one of the pair of rollers to rotate, and the driven roller causes the other of the pair of rollers to rotate, the rollers can be caused to rotate in opposite directions. In a case where the pivot axis of the pivot supporting member, which supports one or both rollers, is the rotation axis of the drive roller and/or the driven roller, then the rotation can be transmitted without interference by the wrapping transmission member at all times, even if the distance between the axes of the pair of rollers is adjusted. It is also possible for the drive roller and/or the driven roller and the supporting member to be supported on the same axis, making the structure of the device simpler.

DETAILED DESCRIPTION OF THE EMBODIMENTS

Overall Structure of Strip-Pack Manufacturing Apparatus

Figure 1:
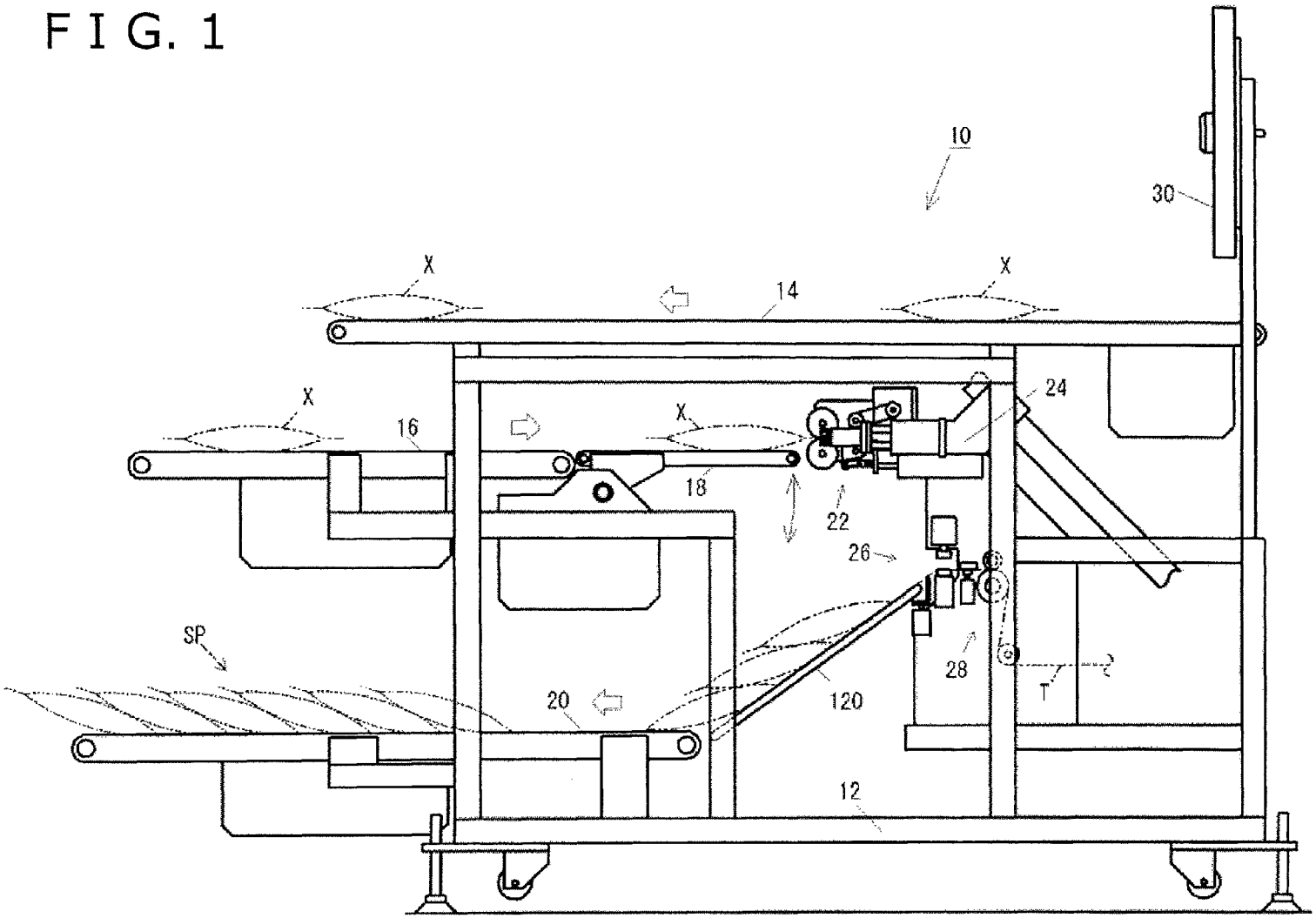
FIG. 1 is a lateral view of a strip-pack manufacturing apparatus according to an embodiment of the present invention.

FIG. 1 shows a strip-pack manufacturing apparatus according to an embodiment of the present invention.

Figure 2A:
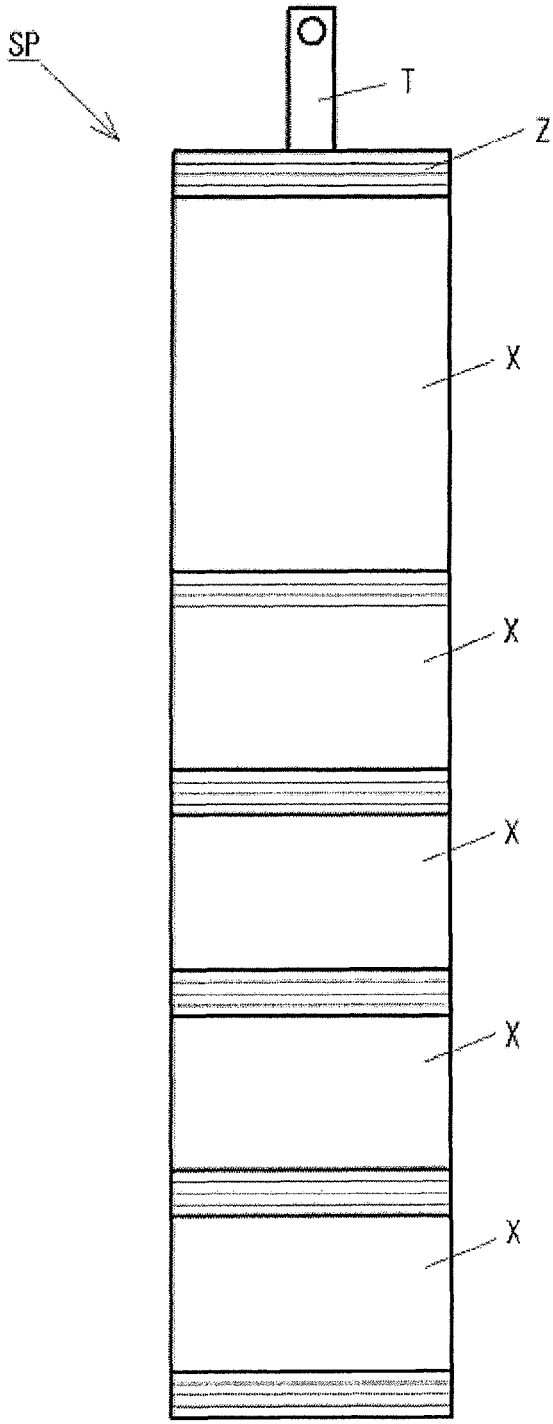
FIG. 2A is a front view of a strip pack manufactured by the strip-pack manufacturing apparatus of FIG. 1.
Figure 2B:
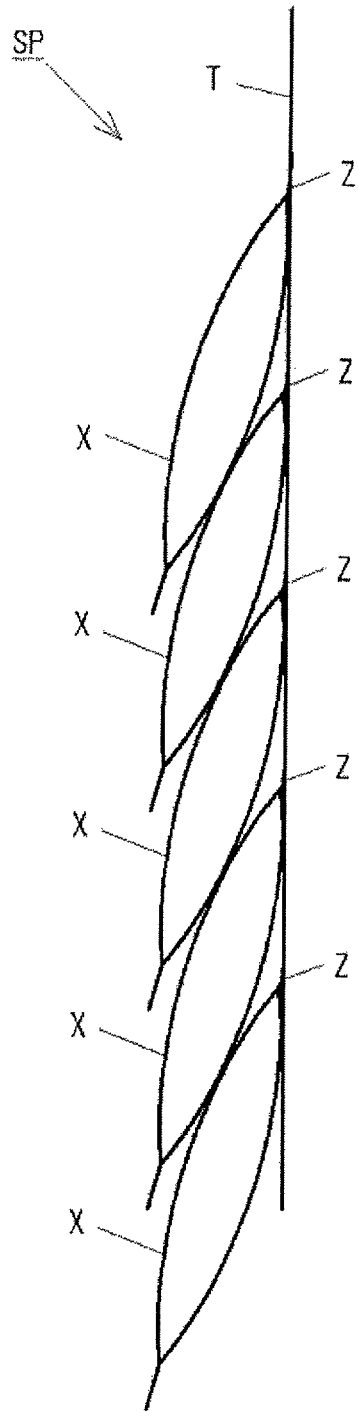
FIG. 2B is a lateral view of the strip pack manufactured by the strip-pack manufacturing apparatus of FIG. 1.

A strip-pack manufacturing apparatus 10, which is shown in FIG. 1, is used to manufacture a so-called strip pack SP, which is shown in FIG. 2. The strip pack SP comprises a plurality of bags X filled with snack foods or the like, and attached at an end Z to a strip T such as a strip-like film, tape, or the like.

The strip-pack manufacturing apparatus 10 comprises a main unit 12, a supply conveyor 14, an induction conveyor 16, a drop conveyor 18, a discharge conveyor 20, a brush unit 22, a transport unit 24, an attachment unit 26, a strip-delivering unit 28, and other components.

A bag X delivered from an upstream device is supplied to the supply conveyor 14. The induction conveyor 16 introduces the bag X supplied by the supply conveyor 14 into the inside of the main device 10. The drop conveyor 18 constitutes an end of the induction conveyor 16. The discharge conveyor 20 discharges a strip pack SP manufactured by the main device 10 to a downstream device. The brush unit 22 positions the end Z of the bag X introduced into the inside of the main device 10. The transport unit 24 conveys the bag X that has been positioned by the brush unit 22 while holding the end Z of the bag X. The attachment unit 26 attaches a strip T to the end Z of the bag X held by the transport unit 24. The strip-delivering unit 28 delivers the strip T.

The four conveyors 14, 16, 18, 20 are configured to convey the bag X or a strip pack in a horizontal direction. The strip T is disposed at an upper part of the strip-pack manufacturing apparatus 10 in the form of a rolled-up strip roll 30 to enable uncomplicated replacement (the route over which the strip T is conveyed from the strip roll 30 to the strip-delivering unit 28 is omitted in the drawing).

The white arrows in the drawing indicate the direction in which the bag X or strip pack SP is conveyed.

Figure 3:
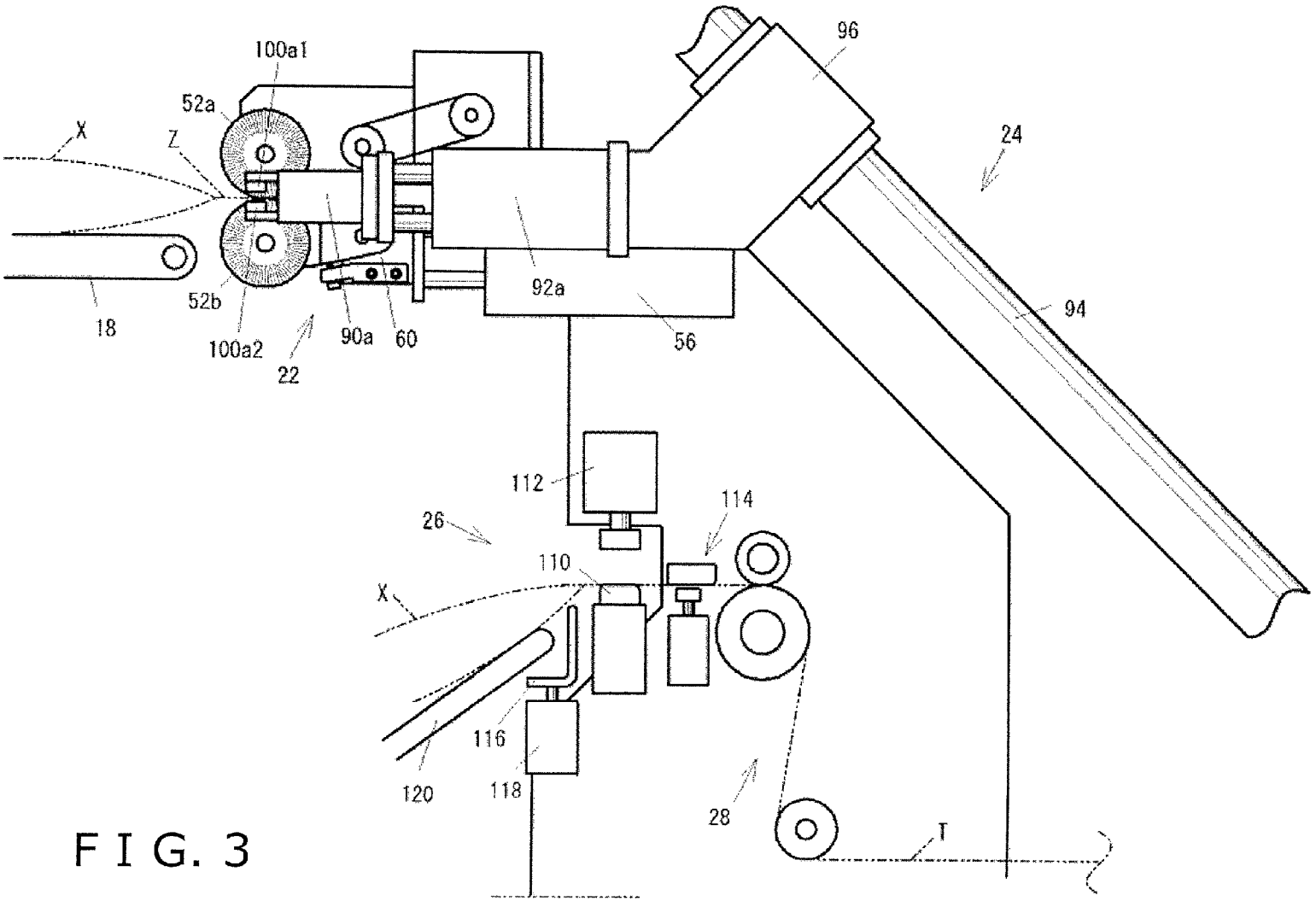
FIG. 3 is a partial enlarged view of FIG. 1, showing a detailed structure of a part of the strip-pack manufacturing apparatus.
Figure 4:
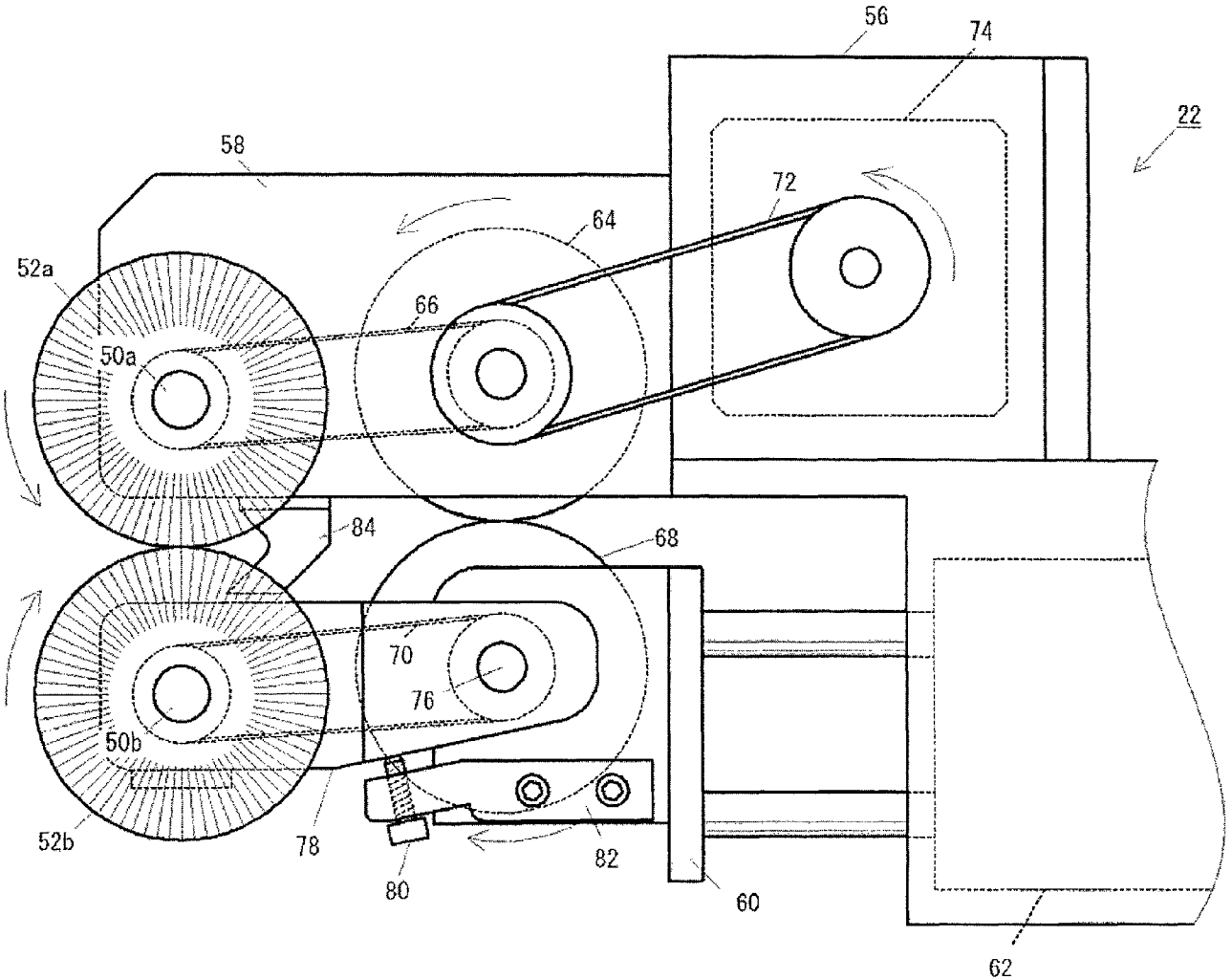
FIG. 4 is an enlarged lateral view of a brush unit.
Figure 5:
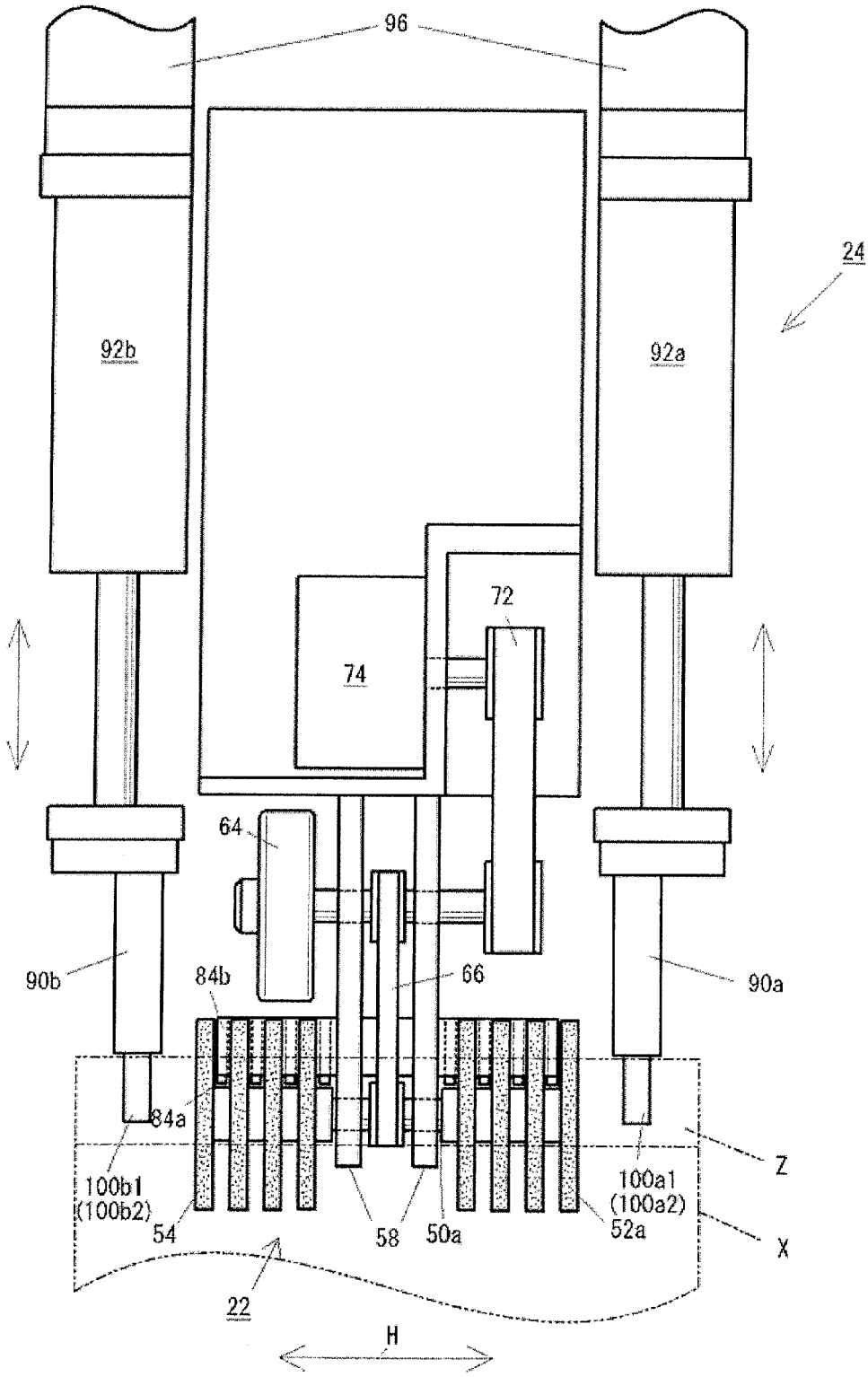
FIG. 5 is a top plan view of the brush unit and a conveying unit as seen vertically from above.
Figure 6:
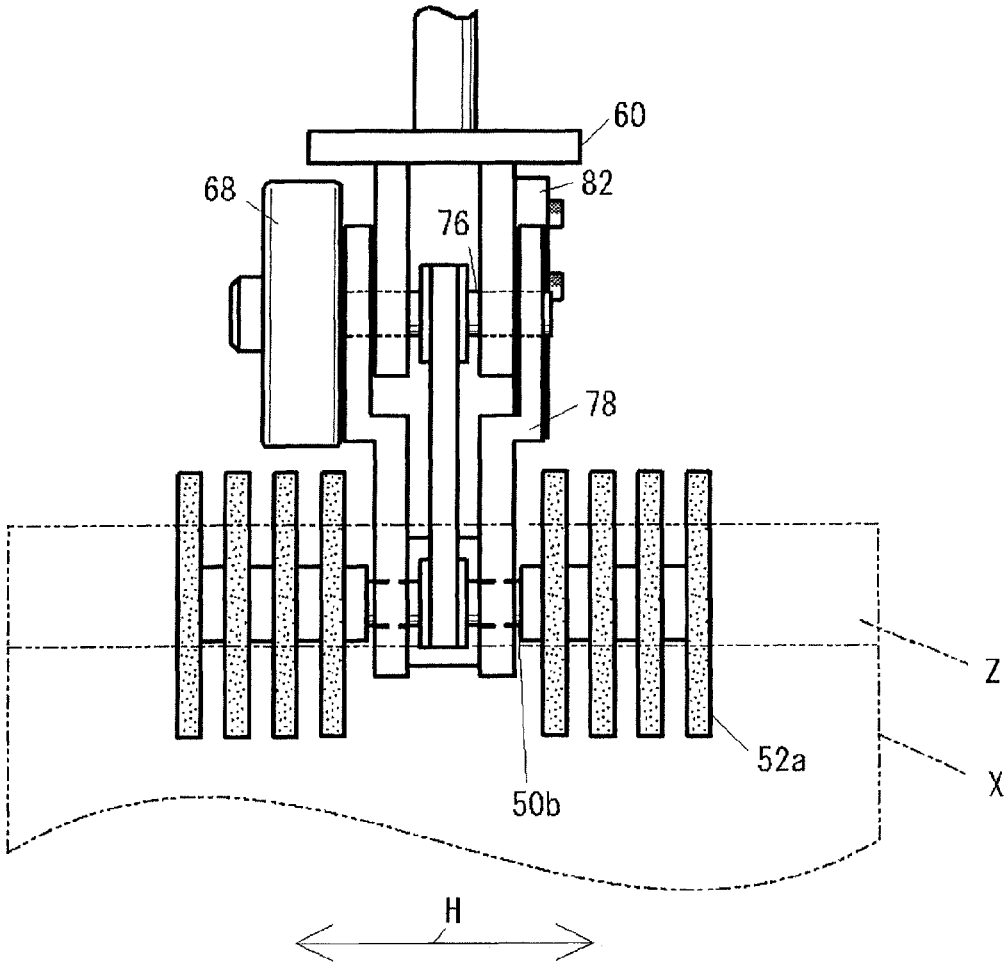
FIG. 6 is a top plan view of a lower section of the conveying unit as seen vertically from above.

FIG. 3 is an enlargement of the brush unit 22, the transport unit 24, the attachment unit 26, and the strip-delivering unit 28 shown in FIG. 1, as well as the immediate vicinity of each of these units. FIG. 4 shows the brush unit 22 in detail. FIG. 5 shows the upper portion of the brush unit 22 and the transport unit 24 as viewed vertically from above. FIG. 6 shows the lower portion of the brush unit 22 as viewed vertically from above.

Detailed Structure of Brush Unit

As shown in FIG. 4, the brush unit 22 comprises brush rollers 52*a*, 52*b* (examples of the first and second rollers) that have rotating shafts 50*a*, 50*b*. The rotating shafts 50*a*, 50*b* of the brush rollers 52*a*, 52*b* each have a rotation axis that extends in a horizontal direction and lies parallel to each other in a vertical direction. The brush rollers 52*a*, 52*b* are identical in shape, and, as shown in FIGS. 5 and 6, have axial directions (rotation axes) running parallel to the width direction H of the end part Z of the bag X.

The brush rollers 52*a*, 52*b* do not have bristles embedded along the entirety of the rotating shafts 50*a*, 50*b*; bristles 54 are embedded in the rotating shafts 50*a*, 50*b* at fixed intervals in the axial direction.

As shown in FIG. 3, the two brush rollers 52*a*, 52*b* are configured so that the rotation direction of the two rollers at the position where the two brush rollers 52*a*, 52*b* face each other is from the bag X side to the side away from the bag X, and so that the brush rollers will rotate in a state of matched peripheral velocities. This arrangement is adopted in order for the end part Z of the bag X conveyed by the drop conveyor 18 to be drawn between the two rollers.

A more specific description shall now be given. The brush roller 52*a* is rotatably supported by a supporting member 58, as shown in FIG. 4. The supporting member 58 is integrally formed with a housing 56 of the brush unit 22. The brush roller 52*b* is rotatably supported by a supporting member 60 (strictly speaking, a moving bracket (described further below)) that is separate from the housing 56. The supporting member 60 for supporting the brush roller 52*b* is supported by a linear actuation mechanism 62. The linear actuation mechanism 62, which is attached to the housing 56, moves the supporting member 60 in a direction that is both horizontal and perpendicular to the width direction H of the end part Z of the bag X.

The term "linear actuation mechanism" is used in the present description to refer to a mechanism that is capable of moving an object to be supported forward or backward in a single direction, and that can stop the object at any position along that direction. An air cylinder is an example of such a mechanism.

The brush roller 52*a* is caused to rotate via a belt 66 in concert with the rotation of a drive roller 64. The drive roller 64 is rotatably supported by the supporting member 58. The driven roller 68 is rotatably supported by the supporting member 60, and makes contact on an outer peripheral surface with the drive roller 64. Accordingly, the driven roller 68, which has the same outer peripheral length as the drive roller 64, rotates in concert with the drive roller 64. The brush roller 52*b* is caused to rotate via a belt 70 (one example of the winding transmission member) in concert with the rotation of the driven roller 68. The drive roller 62 is caused to rotate via a belt 72 (one example of the winding transmission member) by the rotation of a rotating shaft of a motor 74 attached to the housing 56.

It is possible to adjust the distance between the axes of the brush rollers 52*a*, 52*b* (distance between the rotation axes) in the brush unit 22; i.e., the gap between the two brush rollers 52*a*, 52*b*. The brush roller 52*b* is supported by a pivot supporting member 78 in order to allow the gap to be adjusted. The pivot supporting member 78 is pivotally supported on a shaft 76 that rotatably supports the driven roller 68. A bolt 80 against which the underside of the pivot supporting member 78 rests is provided for positioning the pivot supporting member 78. The bolt 80 is threaded through a bolt hole in a plate 82 that is attached to the supporting member 60.

Figure 7:
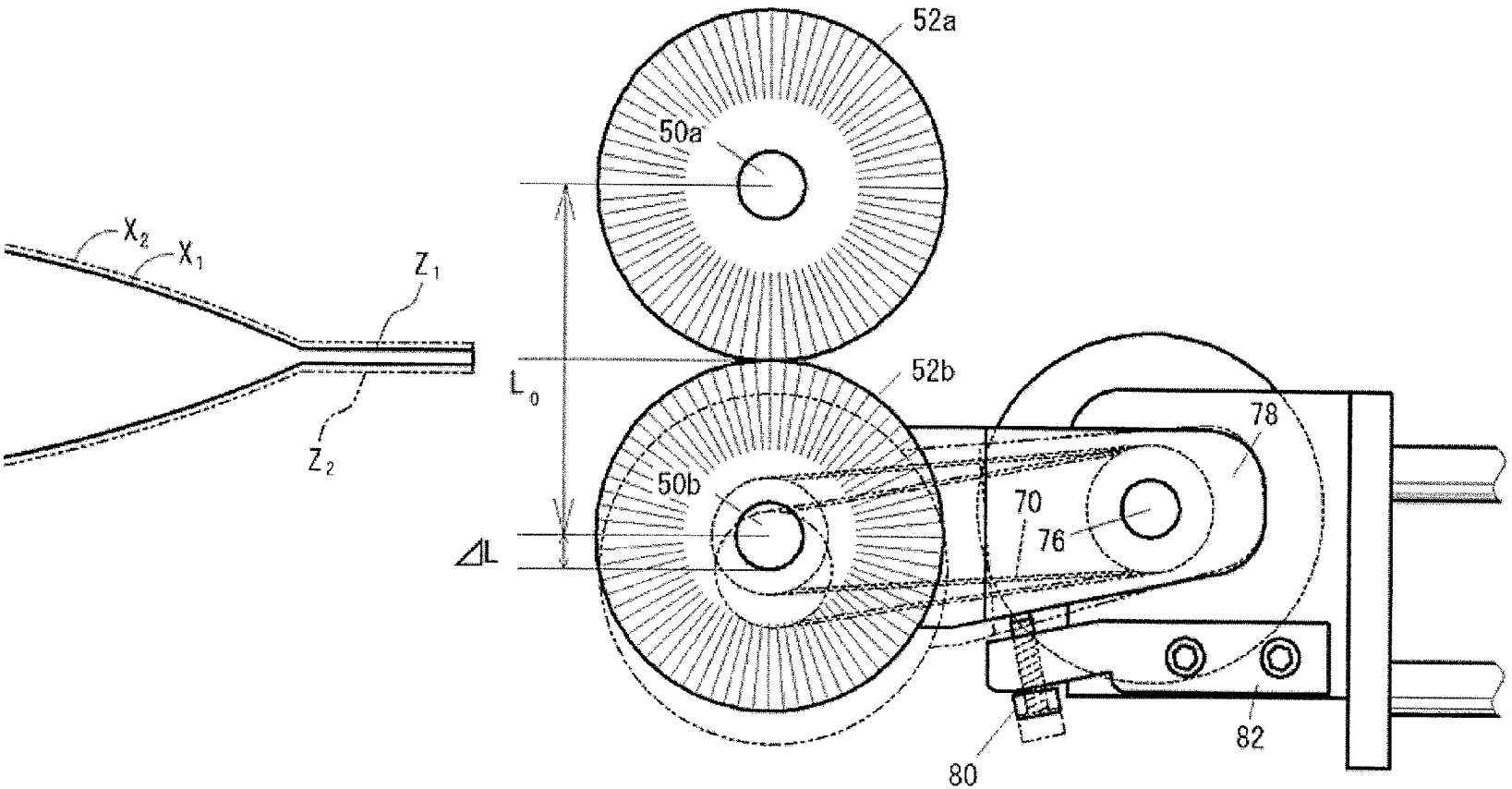
FIG. 7 is a lateral view used to illustrate a method for adjusting the distance between the axes of two brush rollers.

The distance between the axes of the two brush rollers 52*a*, 52*b* is adjusted by turning the bolt 80, which changes the extent to which the bolt 80 protrudes form the plate 82, and causes the pivot supporting member 78 that rests on the bolt 80 to pivot around the shaft 76, as shown in FIG. 7. Specifically, the distance between the axes of the two brush rollers 52*a*, 52*b* can be adjusted merely by adjusting the pivot angle of the pivot supporting member 78 with respect to the shaft 76. For example, if the bags that are handled by the strip-pack manufacturing apparatus 10 are changed from a bag $X_1$ to a bag $X_2$ (having an end part $Z_2$ that is thicker than an end part $Z_1$ of the bag $X_1$), then the distance between the axes is changed from $L_0$ to $L_0+\Delta L$.

The pivot supporting member 78 is supported on the shaft 76, whose rotation axis is parallel to the rotation axis of the brush roller 52*b*. The driven roller 68 is also supported on the shaft 76; therefore, even if the distance between the axes of the brush rollers 52*a*, 52*b* is adjusted, the rotation provided by the belt 70 will be transmitted without interference at all times. Moreover, since the shaft 76 on which the pivot supporting member 78 pivots also supports the driven roller 68, the structure of the brush unit 22 is made simple.

The brush unit 22 additionally has a stopper member 84, as shown in FIG. 4. The end part Z of a bag X that is drawn between the brush rollers 52*a*, 52*b* is controlled by the stopper member 84 in terms of the position to which the end part Z is drawn. The stopper member 84 comprises a plurality of stopping parts 84*a* and supporting parts 84*b*. As shown in FIG. 5, the plurality of stopping parts 84*a* are arranged between the bristles 54 of the brush rollers 52*a*, 52*b*, and are used to control the position to which the end part Z of the bag X is drawn. The supporting parts 84*b* are attached to a bracket 58, and are used to support the plurality of stopping parts 84*a*.

The brush unit 22 thus controls the end parts Z of the bags X that have been conveyed by the drop conveyor 18 to be pulled in the drawing direction of the two brush rollers 52*a*, 52*b*, and held in a horizontal state at a predetermined position while being kept flat.

Detailed Structure of Conveyor Unit

As shown in FIGS. 3 and 5, the transport unit 24 comprises chuck mechanisms 90*a*, 90*b* (examples of the holding part), linear actuation mechanisms 92*a*, 92*b*, and a guide mechanism 96.

The chuck mechanisms 90*a*, 90*b* clamp the end part Z of the bag X whose position is controlled by the brush unit 22 to stop at a predetermined position in a horizontal state.

The linear actuation mechanisms 92*a*, 92*b* move the chuck mechanisms 90*a*, 90*b* in a horizontal direction and in the aforedescribed drawing direction.

The guide mechanism 96 moves along a guide rail 94 while supporting the linear actuation mechanisms 92*a*, 92*b*.

The chuck mechanism 90*a* has a pair of jaws 100*a*1, 100*a*2 for holding therebetween the end part Z of the bag X. The chuck mechanism 90*b* similarly has a pair of jaws 100*b*1, 100*b*2.

The pairs of jaws 100*a*1, 100*a*2 and jaws 100*b*1, 100*b*2 of the chuck mechanisms 90*a*, 90*b* clamp the bag X therebetween in the vertical direction.

Figure 8:
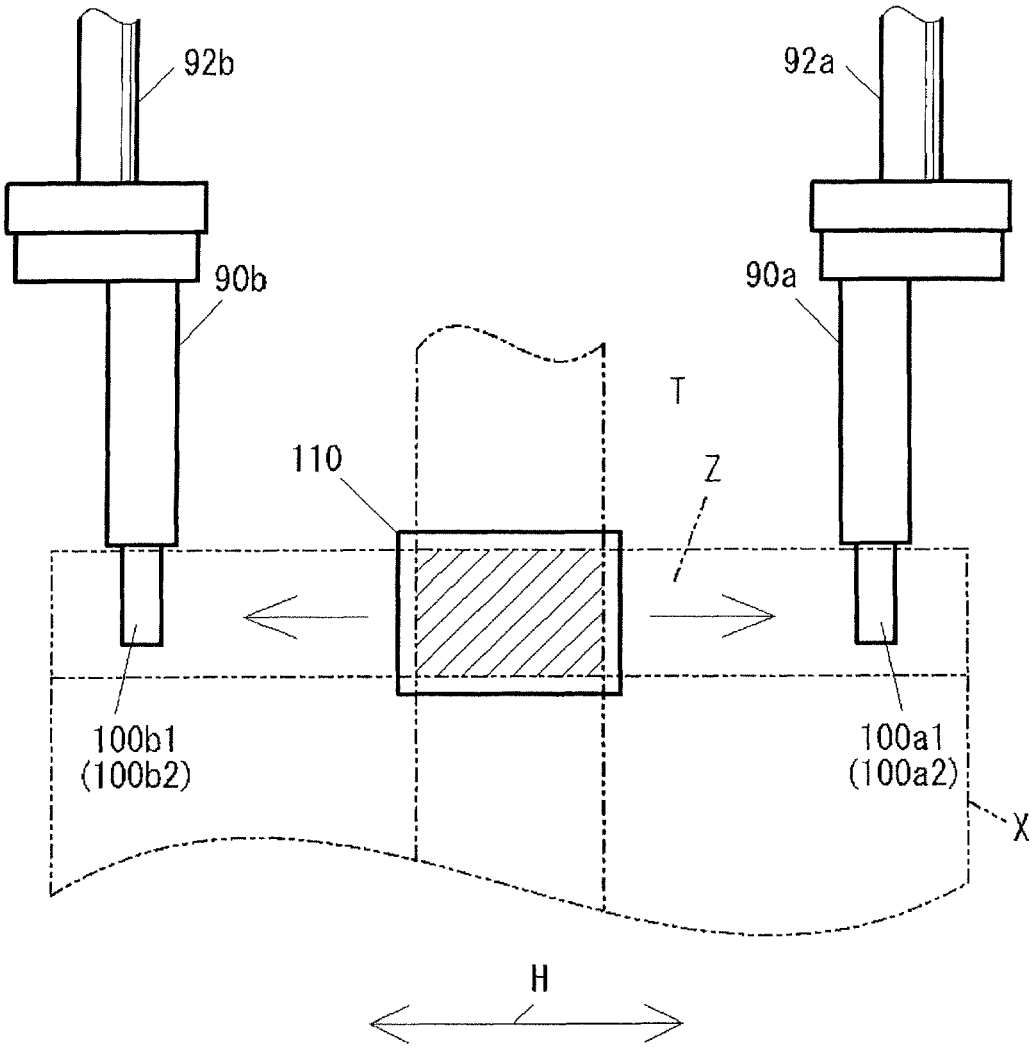
FIG. 8 is a top plan view used to illustrate a state in which an end of an article is attached to a strip.

The linear actuation mechanisms 92*a*, 92*b* and the guide mechanism 96 are used to convey the bag X whose end part Z is held by the chuck mechanisms 90*a*, 90*b*. Specifically, the bag X is conveyed such that a central portion of the end part Z which is between a portion sandwiched by the pair of claws 100*a*1, 100*a*2 and a portion sandwiched by the pair of claws 100*b*1, 100*b*2 of the chuck mechanisms 90*a*, 90*b* is positioned on a strip T on a heater 110 of the attachment unit 26 (see FIG. 8).

Accordingly, the linear actuation mechanisms 92*a*, 92*b* move the chuck mechanisms 90*a*, 90*b* in a horizontal direction, and the guide mechanism 96 moves along the guide rail 94. For purposes of assistance, the supporting member 60 of the brush unit 22 is constructed so as to be moved toward the housing 56 by the linear actuation mechanism 62. The drop conveyor 18 is constructed so as to shift from a horizontal state to a tilted state (in order to drop the bag X).

Detailed Structure of Attachment Unit

The attachment unit 26 is constructed so that the central portion of the end part Z of the bag X (see FIG. 8) that has been held in a flat state by the chuck mechanisms 90*a*, 90*b* of the transport unit 24 will be heat-welded to the strip T conveyed by the strip-delivering unit 28.

Specifically, the attachment unit 26 comprises the heater 110, a cylinder 112, a cutter 114, a cylinder 118, and a slider 120. The heater 110 heat-welds the central portion of the end part Z of the bag X to the strip T. The cylinder 112 presses the end part Z on the heater 110 and the strip T against the heater 110 in a stacked state. The cutter 114 cuts the strip T at a predetermined timing. The cylinder 118 presses a melt-preventing member 116 against a reverse surface of the strip T (the surface opposite the side on which the bag X is attached). The melt-preventing member 116 is a member used to prevent the strip T and heater 110 from coming into contact with each other prior to heat-welding, and prevent the strip T from melting under the heat. The slider 120 receives the bag X when heat-welding has been performed, and slides the strip pack SP onto the discharge conveyor 20.

Operation of Strip-Pack Manufacturing Apparatus

According to the present embodiment, the bag X is conveyed by the supply conveyor 14, the induction conveyor 16, and the drop conveyor 18 in the stated order; and the end part Z is drawn between the brush rollers 52*a*, 52*b* of the brush unit 22, and the position of the end pat Z is controlled by the stopper member 84 to stop at a predetermined position while being kept horizontal.

In the transport unit 24, the end part Z whose position is controlled by the brush unit 22 to stop at a predetermined position while being kept horizontal is held from both sides by the chuck mechanisms 90*a*, 90*b*. The transport unit 24 conveys the bag X to the attachment unit 26.

The attachment unit 26 attaches the central portion of the end part Z to the strip T.

These actions are performed repeatedly so that a plurality of bags X will be attached to the strip T, whereupon the cutter 114 of the attachment unit 26 cuts the strip T. The resulting strip pack SP in which a plurality of bags X are attached by their respective end parts Z to the strip T slides onto the slider 120, and is subsequently discharged from the strip-pack manufacturing apparatus 10 by the discharge conveyor 20.

This sequence of actions is reliably executed, even if bags X having end parts Z of a certain thickness are changed for bags X having end parts Z of a different thickness. Specifically, regardless of the thickness of the end parts Z of the bags X, changing the distance between the axes of the brush rollers 52*a*, 52*b* of the brush unit 22 will enable the end parts Z to be reliably drawn by the two brush rollers 52*a*, 52*b* as far as the stopper member 84. This will enable the end parts Z to be reliably positioned, and it will be possible to reliably hold the end parts Z that is positioned from both sides by the chuck mechanisms 90*a*, 90*b* of the brush unit 22.

OTHER EMBODIMENTS

A description of the present invention has been provided with reference to the embodiment given above, but this embodiment is not provided by way of limitation to the present invention.

For example, according to the above embodiment, only one supporting member that supports one brush roller pivots to allow the distance between the axes of the two brush rollers to be adjusted; however, it is possible that supporting members of the both brush rollers can pivot, which will allow bags having thicker end parts to be handled.

According to the above embodiment, furthermore, the supporting member of the brush roller is caused to pivot around a rotation axis that is parallel to the rotation axis of the brush roller, whereby the distance between the axes of the two brush rollers is adjusted; however, an alternate method may be adopted. For example, at least one of the two brush rollers can be supported by a supporting member that is capable of moving in the direction of the distance between the axes, and, when the distance is to be changed, the supporting member can be moved by a servomotor via, e.g., a ball screw.

According to the above embodiment, furthermore, brush rollers are used; however, rubber rollers or another variety of flexible roller may be used.

As has been described in the foregoing, the illustrated embodiment is adaptable to a variety of bags having end parts of varying thickness. Accordingly, the illustrated embodiment may be favorably used in the field of strip-pack manufacturing apparatuses.

The invention claimed is:

1. A strip-pack manufacturing apparatus adapted to attach an end part of an article to a strip, the strip-pack manufacturing apparatus comprising:

a drive roller configured and arranged to be driven by a motor;

a driven roller configured and arranged to rotate in contact with the drive roller;

a holding part configured and arranged to hold the article and to transport the article from a receiving position at which the holding part receives the article, downward to a predetermined attaching position;

first and second rollers arranged in the receiving position at which the holding part receives the article, the first and second rollers being configured and arranged to rotate while sandwiching the end part of the article therebetween;

winding members configured and arranged to rotate the first and second rollers in association with the drive roller and the driven roller;

a stopper member configured and arranged to control the position of the end part of the article that has been drawn by rotation of the first and second rollers to stop at a predetermined position;

first and second supporting members respectively supporting the first and second rollers; and an adjusting part configured and arranged to move one of the first and second supporting members to pivot around a pivot axis that is parallel to rotation axes of the first and second rollers to adjust a distance between the rotation axes of the first and second rollers, the pivot axis of at least one of the first and second supporting members being a rotation axis of one of the drive roller and the driven roller.

2. The strip-pack manufacturing apparatus of claim 1, wherein the first supporting member is non-movably supported to a housing, and the second supporting member is movably supported to the housing.

3. The strip-pack manufacturing apparatus of claim 2, wherein the second supporting member includes a first portion and a second portion, the first portion being supported to the housing for linear movement relative to the housing and the first supporting member, the second portion being pivotally supported to the first portion for pivoting movement about the pivot axis.

4. The strip-pack manufacturing apparatus of claim 3, wherein the holding part includes a guide mechanism with the housing being fixedly supported to the guide mechanism, the guide mechanism being configured and arranged to move the housing between the receiving position and the predetermined attaching position.

5. The strip-pack manufacturing apparatus of claim 2, further comprising a drive roller that is driven by a motor, the motor being attached to the housing, the drive roller being rotatably supported by the first supporting member, and a driven roller that rotates in contact with the drive roller, the first and second rollers being configured and arranged to rotate in association with the drive roller and the driven roller, respectively, via winding transmission members, and the pivot axis of the second supporting member being a rotation axis of the driven roller.

6. The strip-pack manufacturing apparatus of claim 5, wherein the second supporting member includes a first portion and a second portion, the first portion being supported to the housing for linear movement relative to the housing and the first supporting member, the second portion being pivotally supported to the first portion for pivoting movement about the pivot axis.

7. The strip-pack manufacturing apparatus of claim 6, wherein the holding part includes a guide mechanism with the housing being fixedly supported to the guide mechanism, the guide mechanism being configured and arranged to move the housing vertically between the receiving position and the predetermined attaching position.

* * * * *